United States Patent [19]

Tremmel et al.

[11] 4,384,929

[45] May 24, 1983

[54] PROCESS FOR ELECTRO-DEPOSITING COMPOSITE NICKEL LAYERS

[75] Inventors: Robert A. Tremmel, Woodhaven; Doina Magda, Grosse Point Park, both of Mich.

[73] Assignee: Occidental Chemical Corporation, Warren, Mich.

[21] Appl. No.: 280,643

[22] Filed: Jul. 6, 1981

[51] Int. Cl.[3] ..... C25D 5/12

[52] U.S. Cl. ..... 204/40; 204/43 T; 204/49

[58] Field of Search ..... 204/49, 41, 40, 43 T, 204/123, 112

[56] References Cited

U.S. PATENT DOCUMENTS

| | | | |
|---|---|---|---|
| 3,090,733 | 5/1963 | Brown | 204/40 |
| 3,795,591 | 3/1974 | Clauss et al. | 204/43 T |
| 3,857,765 | 12/1974 | Merker et al. | 204/49 |

FOREIGN PATENT DOCUMENTS

| | | | |
|---|---|---|---|
| 261025 | 12/1962 | Australia | 204/49 |
| 890528 | 3/1962 | United Kingdom | 204/49 |
| 551415 | 5/1977 | U.S.S.R. | 204/49 |

*Primary Examiner*—G. L. Kaplan

*Attorney, Agent, or Firm*—Richard P. Mueller

[57] ABSTRACT

An improved composition and process for producing a composite nickel-containing electroplate on a substrate including an inner nickel-containing layer of an average sulfur content of less than about 0.03 percent by weight, an intermediate nickel-containing layer of an average sulfur content of about 0.05 to about 0.5 percent by weight and an adjacent adherent outer nickel layer of an average sulfur content of about 0.02 to about 0.15 percent but less in sulfur than the intermediate layer and higher in sulfur than the inner layer. The controlled amount of sulfur is introduced into at least the intermediate layer by employing an aqueous acidic nickel solution containing a controlled amount of a thiazole compound so as to provide an intermediate nickel-containing deposit containing the specified average sulfur content.

12 Claims, No Drawings

PROCESS FOR ELECTRO-DEPOSITING COMPOSITE NICKEL LAYERS

BACKGROUND OF THE INVENTION

The present invention relates to an improved electrolyte composition and process for electrodepositing a composite nickel containing electroplate on a corrosion susceptible base metal to achieve corrosion protection thereof. The composite electroplate comprises three adjacent, bonded nickel-containing layers each of a controlled thickness and controlled sulfur content which normally are provided with a conventional chrome plate over the surface of the outer nickel layer achieving exceptional outdoor corrosion protection of the basis metal in comparison to a single or even a duplex nickel-containing electroplate of the same thickness. Such composite nickel-containing electroplates are in widespread commercial use for protecting basis metals such as steel, copper, brass, aluminum or zinc die castings which are subject to outdoor exposure during service, particularly, to marine and automotive service conditions. Beneficial results in corrosion protection are also achieved in the use of such composite nickel-containing layers on plastic substrates which have been subjected to a suitable pretreatment in accordance with well-known techniques to provide an electrically conductive coating thereover such as a copper layer rendering the plastic substrate receptive to nickel electroplating. Typical of such plastic materials which can be electroplated are ABS, polyolefin, polyvinylchloride, and phenolformaldehyde polymers. Such composite nickel-containing electroplates when used in connection with plastic substrates substantially reduce or eliminates so-called "green" corrosion stains produced by a corrosive attack of a copper basis layer or flash.

Typical of such prior art composite nickel-containing electroplating processes and compositions are those disclosed in U.S. Pat. Nos. 3,090,733 and 3,703,448 the substance of which are incorporated herein by reference. In accordance with U.S. Pat. No. 3,090,733 issued May 21, 1963 a process is disclosed for electrodepositing a three-layered nickel-containing deposit on a substrate in which at least the operating bath for applying the intermediate nickel layer contains selected sulfur compounds to effect a controlled sulfur content in the intermediate nickel-containing layer to achieve the requisite adherence between the composite layers and corrosion protection of the underlying substrate. A further improvement in the foregoing process is disclosed in U.S. Pat. No. 3,703,448 issued Nov. 21, 1972 in which alternative sulfur compounds comprising thiosulfonates of nitriles or amides are employed at least in the operating bath for electrodepositing the intermediate layer.

The composition and process of the present invention provides for still further improvements over the compositions and processes disclosed in the aforementioned two patents employing a novel sulfur compound at least in the operating bath for electrodepositing the intermediate layer which provides for improved bath stability in the presence of air agitation, high temperature and low pH providing for increased plating speeds and reduced consumption of the additive compound. The novel sulfur additive compound of this invention provides the further advantages in that it can readily be analyzed in the operating bath to maintain its concentration within the optimum operating range and contamination of the operating bath for applying the outer nickel-containing layer with the sulfur additive compound by drag-in from the intermediate layer operating bath does not appreciably effect the sulfur concentration of the outer nickel-containing layer. This latter advantage is important because normally a water rinse step is not employed between the intermediate and outer nickel plating steps and an undesirable increase in sulfur content of the outer nickel layer can in some instances result in hindrance of coverage of the final chromium electrodeposit.

SUMMARY OF THE INVENTION

The benefits and advantages of the present invention are achieved in accordance with the composition aspects thereof by providing an electrolyte comprising an aqueous acidic solution containing nickel ions present in an amount sufficient to deposit an intermediate nickel-containing layer and a thiazole compound present in an amount to provide a sulfur content in the deposited intermediate nickel-containing layer of about 0.05 to about 0.5 percent and of a structural formula:

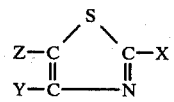

wherein:

X, Y and Z are the same or different and are H, $NH_2$, $CH_3$, SH, a halogen or $NO_2$, as well as the inner salts thereof.

In order to attain a sulfur concentration in the intermediate layer within the range hereinabove specified, the thiazole compound is typically present in an amount of about 0.01 to about 0.4 grams per liter (g/l) with amounts of about 0.03 to about 0.1 g/l being preferred. The intermediate operating bath may also optionally and preferably contain wetting agents and buffering agents such as boric acid, for example.

In accordance with the process aspects of the present invention, a metal substrate, or a plastic substrate the surface of which has been rendered electrically conductive, is electroplated to form an inner nickel-containing layer generally of a thickness of about 0.15 to about 1.5 mils containing an average sulfur concentration of less than about 0.03 percent followed by the electrodeposition of an intermediate nickel-containing layer at a thickness of about 0.005 to about 0.2 mils and a sulfur content of about 0.05 to about 0.5 percent followed by an outer nickel-containing layer of a thickness generally about 0.2 to about 1.5 mils and a sulfur content of about 0.02 to about 0.15 percent. The sulfur concentration of the outer nickel layer is less than that of the intermediate layer but is greater than that of the inner layer which may be substantially sulfur free. Typically, each of the three nickel-containing layers can be electrodeposited from a Watts-type nickel plating bath with the intermediate and outer operating baths containing the thiazole additive compound in concentrations sufficient to deposit the requisite sulfur content in the respective layers. The individual operating baths generally are operated within a temperature of about room temperature (20° C.) up to about 85° C. and in the case of acidic operating baths, within a pH range of about 1 to 6.

Additional benefits and advantages of the present invention will become apparent upon a reading of the Description of the Preferred Embodiments taken in conjunction with the specific examples provided.

DESCRIPTION OF THE PREFERRED EMBODIMENTS

The composite nickel-containing electroplate can be produced employing electrolytes of the types disclosed in U.S. Pat. Nos. 3,090,733 and 3,703,448, the substance of which is incorporated herein by reference, with the exception that in at least the intermediate operating bath, the sulfur compound comprises the thiazole compound or derivatives thereof of the specific types hereinafter to be described. Accordingly, the electrolyte for depositing the inner nickel layer may comprise a Watts-type nickel plating bath, a fluoroborate, a high chloride, a sulfamate nickel plating bath or a substantially sulfur-free semi-bright nickel plating bath of the types heretofore known. The electrolyte for depositing the intermediate nickel-containing layer may be of the same type employed for depositing the inner nickel-containing layer but further containing the thiazole additive compound in appropriate amounts to achieve the requisite sulfur content in the intermediate layer. Similarly, the electrolyte for depositing the outer nickel-containing layer may be similar to that employed for the intermediate layer with the exception that the concentration of the thiazole compound or alternative sulfur-containing compounds will be controlled to provide a net sulfur content in the outer layer in an amount less than that of the intermediate layer. When a decorative plating finish is desired, the outer nickel-containing layer is preferably produced from a bright nickel plating bath employing one or more of the organic sulfo-oxygen compounds such as set forth in Table II of U.S. Pat. No. 2,513,280 and Table II of U.S. Pat. No. 2,800,440, which compounds are also preferably used with unsaturated compounds or amines to give both leveling and brilliance. The three nickel-containing electrolytes may also contain optional components of the types conventionally employed including bath soluble and compatible wetting agents to prevent pitting, buffering agents such as boric acid, formic acid, citric acid, acetic acid, fluoboric acid, or the like.

An electrolyte suitable for depositing the inner nickel-containing layer comprises a Watts-type bath containing about 200 to about 400 g/l nickel sulfate hexahydrate, about 30 to about 100 g/l nickel chloride hexahydrate, and about 30 to about 60 g/l boric acid as a buffering agent. The bath can be operated at a temperature of about room temperature (20° C.) up to about 85° C. at a pH of about 1 to about 6.

The intermediate high sulfur nickel-containing layer can be deposited from an electrolyte as employed for the inner nickel-containing layer but further containing from about 0.01 to about 0.4 g/l and preferably from about 0.03 to about 0.1 g/l of a thiazole additive compound of a structural formula:

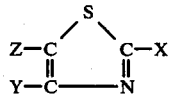

wherein:

X, Y and Z are the same or different and are H, $NH_2$, $CH_3$, SH, a halogen or $NO_2$, as well as the inner salts thereof.

Particularly suitable thiazole compounds comprise those in which X comprises a $NH_2$ group to provide 2-amino thiazole. Additional thiazole compounds which have been found particularly effective in the practice of the present invention which are encompassed by the foregoing structural formula include 2-amino-4-methylthiazole, 2-amino-4,5-dimethylthiazole, 2-mercaptothiazoline, 2-amino-5-bromothiazole monohydrobromide; 2-amino-5-nitrothiazole or the like.

The specific quantity of the thiazole additive compound added to the electrolyte for the intermediate nickel-containing layer will vary depending upon the specific molecular weight of the compound or mixture of compounds employed, the concentration of other constituents present in the electrolyte, the operating parameters under which the bath is operated and the relative concentration of sulfur in the outer nickel layer to be deposited. Conventionally, the thiazole additive compound is controlled so as to provide a sulfur content in the intermediate layer from about 0.05 up to about 0.5 percent by weight, and preferably, about 0.1 to about 0.2%. This sulfur content can usually be attained by employing the thiazole additive compound at a concentration of about 0.01 to about 0.4 g/l with amounts of about 0.03 to about 0.1 g/l usually being preferred.

The outer nickel-containing layer is electrodeposited from an electrolyte similar to that employed for depositing the inner layer with the exception that the outer layer electrolyte contains appropriate sulfur compounds so as to deposit sulfur in the outer nickel-containing layer within a range of about 0.02 to about 0.15 percent by weight. Appropriate sulfur compounds which are preferred are those conventionally employed in bright and satin nickel baths such as, for example, sodium allyl sulfonate, sodium styrene sulfonate, saccharin, benzene sulfonamide, napthalene trisulfonic acid, benzene sulfonic acid and the like. The thiazole additive, benzene sulfinate and thiosulfonates of nitriles or amides are generally not preferred. In any event, the sulfur content in the outer nickel-containing layer is less than that of the intermediate layer but greater than that of the inner layer. The inner layer should have a sulfur content no more than about 0.03 percent by weight, and preferably less than about 0.01% by weight.

In accordance with the process aspects of the present invention, the tri-layered composite nickel-containing electrodeposit is sequentially applied usually without an intervening water rinse between successive electrolytes. The composite nickel-containing layer is usually applied to a substrate having a strike of copper, brass, nickel, cobalt or nickel-iron alloy. The inner nickel-containing layer is usually applied to a thickness of about 0.15 to about 1.5 mils and is preferably applied in a thickness greater than the outer nickel-containing layer. In order to achieve optimum ductility of the composite electroplate, the ratio of thickness of the inner to the outer nickel-containing layers may range from about 50:50 up to about 80:20. If ductility is not a particular problem on the substrate being plated, then the inner layer can be of a thickness less than the outer layer such as a thickness ratio of about 40:60. The intermediate layer is conventionally applied at a thickness of about 0.005 to about 0.2 mils followed by an outer layer of a thickness of about 0.2 to about 1.5 mils.

In order to achieve optimum atmospheric corrosion protection and decorative appearance, it is usually preferred to apply a final bright conventional chromium plate or a micro-cracked chromium plate or a microporous chromium plate of a thickness of about 0.005 to about 0.2 mils over the outer nickel-containing layer. For substrates that are to be exposed to less severe corrosive conditions during service, the inner and outer nickel-containing layers may be only about 0.15 mils thick to provide for improved corrosion protection.

It will be appreciated that the nickel-containing layers comprising the composite plate may contain other conventional contaminants present in conventional amounts which are introduced into the electrolyte and incorporated in the electrodeposit by way of drag-in or the like. Additionally, cobalt may also be present in the nickel-containing layers in appreciable quantities, such as amounts up to about 50 percent cobalt. For general purposes, however, it has been found preferable that the inner nickel-containing layer be as pure a nickel as possible.

In order to further illustrate the improved composition and process of the present invention, the following examples are provided. It will be understood that the examples are provided by way of illustration and are not intended to be limiting of the scope of the invention as herein described and as set forth in the subjoined claims.

EXAMPLE 1

A test solution A comprising a Watts-type nickel plating solution is prepared containing about 40 ounces per gallon nickel sulfate hexahydrate, 8 ounces per gallon nickel chloride hexahydrate and 60 ounces per gallon of boric acid. 800 milliliters of test solution A is added to a 1 liter container equipped with air agitation. The pH of the test solution A is adjusted to 2.5 and the temperature raised to 140° F. (60° C.). 75 mg/l of a wetting agent comprising dihexyl sulfosuccinate is added to the test solution A.

A test solution B is prepared by adding 25 mg/l ($2.5\times10^{-4}$ mols/l) of 2-amino thiazole to test solution A. A nickel foil is plated from test solution B and upon chemical analysis is found to contain 0.105 percent sulfur.

The nickel foil is prepared by electrolytically cleaning a two inch by 4 inch steel panel in an alkaline cleaner followed by water rinsing and an acid dip in a 20 percent solution of sulfuric acid. The acid dipped panel is thereafter water rinsed and plated in a Woods nickel strike to provide a nickel strike layer. The resultant panel is passivated by anodically electrolyzing the panel for a period of from one to two seconds in an alkaline cleaner. Thereafter the panel is plated in test solution B at a current density of 45 asf for a period of 35 minutes. The panel thereafter is water rinsed, dried and the edges are cut and the resultant nickel foil is removed.

EXAMPLE 2

A test solution C is prepared in accordance with the procedure described in Example 1 by adding 40 mg/l ($4.0\times10^{-4}$ mols/l) of 2-amino thiazole to test solution A. A nickel foil is prepared employing the procedure of Example 1 and upon analysis is found to contain 0.162 percent sulfur.

EXAMPLE 3

A test solution D is prepared by adding 50 mg/l ($5\times10^{-4}$ mol/l) of 2-amino thiazole to test solution A and nickel foil is prepared employing the procedure as described in Example 1. A chemical analysis of the sulfur content of the foil reveals a concentration of 0.305 sulfur.

EXAMPLE 4

A test solution C as described in Example 2 is prepared and used under the conditions described in Example 1 for plating a 1.25 by 6 inch steel panel rolled at one end to produce an extremely low current density area. The plating of the panel is conducted at 30 amperes per square foot (ASF) for a period of 7 minutes. The resulting nickel deposit is of a semi-bright lustre with good coverage over the low to high current density areas.

The test solutions B, C, and D as described in the foregoing examples are eminently satisfactory for use as an electrolyte for depositing the nickel-containing intermediate layer to provide a sulfur concentration within the desired range of about 0.05 to about 0.3 percent by weight. The thiazole additive compound provides not only the advantage of improved stability of the electrolyte and high speed plating rates but additionally does not appreciably affect the performance and sulfur content of the outer nickel-containing layer as a result of drag-in of the intermediate layer electrolyte into the outer layer electrolyte. It has been discovered that when using such amino thiazole additive compounds, less sulfur is deposited with an increase in pH. Accordingly, the operation of the intermediate layer electrolyte at a pH of about 2.5 provides satisfactory sulfur content in the intermediate layer. However, drag-in of the additive into the bright nickel electrolyte for depositing the outer nickel-containing layer which typically are at a pH of about 3.5 to about 4.5 does not appreciably raise the sulfur content of the bright nickel outer deposit.

To further substantiate the foregoing advantages, test solution C of Example 2 was incrementally adjusted in pH from 2 to 4 and nickel foils were plated employing a bath temperature of 145° F. at a current density of 45 ASF for a period of 35 minutes in the presence of air agitation. The sulfur content of the foils obtained at each pH level was chemically analyzed and the weight percent of sulfur in the nickel-containing deposit at each pH level is set forth in the following table:

| pH | % Sulfur in Deposit |
|---|---|
| 2.0 | 0.170 |
| 2.5 | 0.156 |
| 3.0 | 0.117 |
| 3.5 | 0.089 |
| 4.0 | 0.070 |

It is apparent from the data as set forth in the foregoing table that the percent of sulfur in the electrodeposit appreciably decreases with an increase in pH.

EXAMPLE 5

Test solutions E, F and G are prepared employing test solution A of Example 1 by adding thereto 25 mg/l ($2.5\times10^{-4}$ mols/l), 50 mg/l ($5\times10^{-4}$ mols/l) and 100 mg/l ($1\times10^{-3}$ mols/l), respectively, of 2-amino-4 methylthiazole of a molecular weight of 114.2.

A brass appearance panel and a nickel foil are plated from each of test solutions E, F and G at a temperature of about 140±5° F. at a pH of 2.5 in the presence of air agitation with each solution containing 75 mg/l of the wetting agent dihexyl sulfosuccinate. The 1 by 6 inch brass appearance panel is first electrolytically cleaned in an alkaline cleaner, rolled at one end to create a low current density area, water rinsed, acid dipped in a 20 percent sulfuric acid solution, water rinsed and thereafter plated in the test solution at about 40 ASF for a period of 5 minutes. The appearance panel is thereafter unrolled and the overall deposit evaluated for appearance in the high and low current density areas as well as for adhesion of the deposit. The nickel foils prepared as described in Example 1 are also analyzed for percent sulfur content.

The nickel foil plated from test solution E provided a sulfur content of 0.088 percent; the nickel foil prepared from test solution F had a sulfur concentration of 0.164 percent; and the nickel foil prepared from test solution G had a sulfur content of 0.424 percent. The appearance of the nickel electroplate produced in each of the test solutions was good and the adhesion of the nickel layer to the substrate was satisfactory.

EXAMPLE 6

A series of test solutions designated as H, I, and J is prepared employing the same procedure as set forth in Example 5 employing the same gram mol concentrations of an alternative thiazole additive compound comprising 2-amino-4,5-dimethylthiazole hydrobromide of an average molecular weight of 209.1 to provide corresponding concentrations of 50 mg/l in test solution H, 100 mg/l in test solution I and 200 mg/l in test solution J.

Nickel foils prepared from these test solutions upon analysis reveal a sulfur content of 0.098 percent from test solution H, a sulfur content of 0.176 produced by test solution I and a sulfur content of 0.528 in the nickel foil plated from test solution J. In each case, the brass appearance panel was of a good appearance and the nickel-containing layer was of satisfactory adhesion.

EXAMPLE 7

A series of test solutions designated as K, L and M is prepared at the same molecular concentration as previously described in connection with Example 5 by the addition to test solution A of Example 1, 25 mg/l, 50 mg/l and 100 mg/l, respectively, of 2-mercaptothiazoline of a molecular weight of 119.2. Nickel foils and brass appearance panels prepared in accordance with the procedure described in Example 5 upon analysis and observation revealed a nickel foil containing 0.348 percent sulfur produced by test solution K, a sulfur content of 0.396 in the nickel foil produced by test solution L and a sulfur content of 0.848 percent in the foil produced employing test solution M. It is apparent that the use of this additive compound in the same molecular concentrations as the compounds previously described in the foregoing examples results in an appreciable increase in the sulfur content of the nickel layer above that normally desired to achieve satisfactory adherence of the overlying outer nickel layer of the composite plate. Nevertheless, the general appearance of the panel was satisfactory and adhesion was acceptable.

EXAMPLE 8

A series of test solutions designated as N, O and P is prepared in the manner as previously described in Example 5 by adding corresponding molecular concentrations of 2-amino-5-bromothiazole monohydrobromide to test solution A of Example 1 to provide concentrations of 62.5, 125 and 250 mg/l, respectively, for test solutions N, O and P. A brass appearance panel and nickel foils are prepared employing the procedure as described in Example 5 and are observed and analyzed. The nickel foil prepared from test solution N is found on analysis to contain 0.112 percent sulfur; the nickel foil from test solution O contains 0.172 percent sulfur while the nickel foil prepared from test solution P contains 0.584 percent sulfur. The appearance of the test panels and the adhesion of the nickel layer is satisfactory.

EXAMPLE 9

A series of test solutions designated as Q, R and S is prepared by adding at the same molar concentration to test solution A of Example 1, 2-amino-5-nitrothiazole of a molecular weight of 145.1 providing corresponding concentrations of 37.5 mg/l of this additive in test solution Q, 75 mg/l in test solution R and 150 mg/l in test solution S. Nickel foils and brass appearance panels prepared employing these three test solutions in accordance with the parameters and procedure described in Example 5 reveals a good appearance and satisfactory adhesion of the nickel deposit. The nickel foil prepared from test solution Q had a sulfur content of 0.092 percent, the foil prepared from test solution R had a sulfur content of 0.112 percent while the nickel foil prepared from test solution S had a sulfur content of 0.54 percent.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. In a process for electrodepositing a composite three-layered nickel containing layer on a substrate wherein an inner nickel-containing layer having an average sulfur content of less than about 0.3 percent by weight is electrodeposited on the substrate, an adherent intermediate nickel-containing layer having an average sulfur content from about 0.05 to about 0.5 percent by weight is electrodeposited on said inner layer and an outer adherent nickel-containing layer having an average sulfur content of from about 0.02 to about 0.15 percent by weight is electrodeposited on said intermediate layer and, wherein, said outer layer contains a lower average sulfur content than said intermediate layer and a higher average sulfur content than said inner layer, the improvement which comprises electrodepositing said intermediate layer from an aqueous acidic solution containing nickel ions in an amount sufficient to deposit the desired intermediate nickel-containing layer and a thiazole compound present in an amount sufficient to provide the desired sulfur content in the deposited intermediate nickel-containing layer, said thiazole compound having the structural formula:

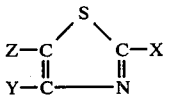

wherein:

X, Y and Z are the same or different and are H, $NH_2$, $CH_3$, SH, a halogen or $NO_2$, as well as the inner salts thereof.

2. The process as claimed in claim 1 wherein said inner layer has a thickness of from about 0.15 to about 1.5 mils, said intermediate layer has a thickness of from about 0.005 to about 0.2 mils and said outer layer has a thickness of from about 0.2 to about 1.5 mils.

3. The process as defined in claim 1 in which said thiazole compound is present in an amount to provide a sulfur content in the deposited nickel-containing intermediate layer of about 0.1 to about 0.2 percent by weight.

4. The process as defined in claim 1 wherein said thiazole compound is an amino thiazole compound.

5. The process as defined in claim 1 where said thiazole compound is 2-amino thiazole.

6. The process as defined in claim 1 wherein said thiazole compound is 2-amino-4-methyl-thiazole.

7. The process as defined in claim 1 wherein said thiazole compound is 2-amino-4, 5-dimethylthiazole.

8. The process as defined in claim 1 wherein said thiazole compound is 2-mercaptothiazoline.

9. The process as defined in claim 1 wherein said thiazole compound is 2-amino-5-bromothiazole monohydrobromide.

10. The process as defined in claim 1 wherein said thiazole compound is 2-amino-5-nitrothiazole.

11. The process as defined in claim 1 in which said thiazole compound is present in an amount of about 0.01 to about 0.4 g/l.

12. The process as defined in claim 1 in which said thiazole compound is present in an amount of about 0.03 to about 0.1 g/l.

* * * * *